US008544666B2

(12) United States Patent
Velmer et al.

(10) Patent No.: US 8,544,666 B2
(45) Date of Patent: Oct. 1, 2013

(54) TAMPER-EVIDENT CONTAINER SYSTEM

(75) Inventors: Marc S. Velmer, Evansville, IN (US); Thomas C. Horton, Newburgh, IN (US)

(73) Assignee: Mead Johnson Nutrition Company, Glenview, IL (US)

( * ) Notice: Subject to any disclaimer, the term of this patent is extended or adjusted under 35 U.S.C. 154(b) by 222 days.

(21) Appl. No.: 12/886,415

(22) Filed: Sep. 20, 2010

(65) Prior Publication Data

US 2012/0067892 A1 Mar. 22, 2012

(51) Int. Cl.
*B65D 17/32* (2006.01)

(52) U.S. Cl.
USPC ..... 215/331; 220/265; 220/288; 220/268; 215/330; 215/252; 215/253

(58) Field of Classification Search
USPC ..... 215/252, 253, 250, 331, 44, 223; 220/268, 260, 265, 266, 288, 289
See application file for complete search history.

(56) References Cited

U.S. PATENT DOCUMENTS

| | | | | |
|---|---|---|---|---|
| 4,448,318 | A | | 5/1984 | Lowe |
| 4,572,388 | A | | 2/1986 | Luker et al. |
| 4,936,474 | A | | 6/1990 | Szczesniak et al. |
| 4,978,017 | A | | 12/1990 | McBride |
| 4,981,230 | A | | 1/1991 | Marshall et al. |
| 5,058,755 | A | | 10/1991 | Hayes |
| 5,096,079 | A | | 3/1992 | Odet |
| 5,137,163 | A | | 8/1992 | Moore |
| 5,145,078 | A | | 9/1992 | Hannon et al. |
| 5,346,082 | A | | 9/1994 | Ochs et al. |
| D360,582 | S | | 7/1995 | McDonald et al. |
| 5,450,972 | A | | 9/1995 | Zemlo |
| 5,472,952 | A | | 12/1995 | Smidt et al. |
| 5,533,633 | A | * | 7/1996 | King ..... 215/252 |
| 5,545,411 | A | | 8/1996 | Chancellor |
| 5,550,106 | A | | 8/1996 | Petschow et al. |
| 5,609,262 | A | | 3/1997 | Trout |
| 5,660,842 | A | | 8/1997 | Petschow |
| 5,803,287 | A | | 9/1998 | Kusz |
| 5,915,579 | A | | 6/1999 | Przytulla et al. |
| 6,003,701 | A | | 12/1999 | Hidding et al. |
| 6,047,840 | A | | 4/2000 | Moore et al. |
| 6,056,136 | A | | 5/2000 | Taber et al. |
| 6,077,558 | A | | 6/2000 | Euber |

(Continued)

FOREIGN PATENT DOCUMENTS

| | | |
|---|---|---|
| WO | 9411267 | 5/1994 |
| WO | 0069742 | 11/2000 |

*Primary Examiner* — Mickey Rush
*Assistant Examiner* — Kareen Rush
(74) *Attorney, Agent, or Firm* — Waddey & Patterson, P.C.; James R. Cartliglia; Matthew C. Cox

(57) ABSTRACT

A container system for storing material includes a container and a mating closure having a tamper-evident ring frangibly attached to the closure. The container includes a neck having a container thread and an annular rim for engaging the tamper-evident ring when the closure is removed from the container. In some embodiments, the neck includes one or more retaining structures for engaging the tamper-evident ring during retort sterilization processing, packaging, shipping or handling. The retaining structure in some embodiments includes one or more ramps having multiple inclined surfaces. Each inclined surface is oriented at an acute angle between about five and about forty-five degrees such that the tamper-evident ring can slip past the retaining structure when a threshold removal torque is applied. A method of sealing a container using a tamper-evident container system is also provided.

16 Claims, 14 Drawing Sheets

(56) References Cited

U.S. PATENT DOCUMENTS

| | | | | |
|---|---|---|---|---|
| 6,227,391 | B1 * | 5/2001 | King | 215/307 |
| 6,253,939 | B1 | 7/2001 | Wan et al. | |
| 6,276,543 | B1 * | 8/2001 | German et al. | 215/252 |
| 6,296,130 | B1 | 10/2001 | Forsyth et al. | |
| 6,382,444 | B1 | 5/2002 | Nyman | |
| 6,436,464 | B1 | 8/2002 | Euber | |
| 6,766,916 | B2 * | 7/2004 | Ma | 215/252 |
| 7,451,885 | B2 | 11/2008 | Nyman et al. | |
| 7,891,510 | B2 * | 2/2011 | Loughrin et al. | 215/252 |
| 2003/0099753 | A1 | 5/2003 | Yang | |
| 2005/0000931 | A1 * | 1/2005 | Bosl et al. | 215/252 |
| 2005/0072751 | A1 * | 4/2005 | Price et al. | 215/252 |
| 2005/0252878 | A1 * | 11/2005 | Babcock | 215/252 |
| 2006/0021959 | A1 | 2/2006 | Falzoni | |
| 2008/0073310 | A1 | 3/2008 | Horton et al. | |
| 2008/0264894 | A1 | 10/2008 | Loughrin et al. | |
| 2008/0314856 | A1 | 12/2008 | Penny et al. | |
| 2009/0057261 | A1 | 3/2009 | Ma et al. | |

* cited by examiner

TAMPER-EVIDENT CONTAINER SYSTEM

BACKGROUND OF THE DISCLOSURE

1. Technical Field

The present disclosure relates generally to container systems for storing materials, and more particularly to containers adapted for engaging a mating closure having a tamper-evident ring.

2. Background Art

Containers having a closure, or cap, for sealing the container are known in the art, especially containers of the type used for storing consumable materials such as nutritional formula or dietary supplements. Closures for sealing containers in many applications include a threaded cap shaped for engaging threads on the container. Such closures in some applications include a tamper-evident ring frangibly attached to the closure. When the closure is initially screwed onto the container, the tamper-evident ring slips past one or more retaining structures. When the closure is loosened, or unscrewed, from the container for the first time, the tamper-evident ring engages the one or more retaining structures on the container. If the closure is rotated further, the tamper-evident ring continues to engage the retaining structure and is broken away from the closure, indicating to a consumer or user that the container has been opened. In many conventional tamper-evident ring configurations, the tamper-evident ring remains on the container following removal of the closure.

Some conventional containers include a retaining structure forming an annular rim, or bead, extending around the perimeter of the container neck for engaging the tamper-evident ring and for retaining the tamper-evident ring on the container after the closure is initially removed. In some conventional configurations, the tamper-evident ring is attached to the closure, or cap, by one or more frangible bridges. The annular rim in such conventional configurations engages the tamper-evident ring as the closure is unscrewed, causing the frangible bridges to experience a force as the cap is moved axially with respect to the container. Axial movement of the tamper-evident ring is generally restricted by the annular rim, or bead, as the cap is unscrewed, and the resulting force causes the frangible bridges to break. Generally, some other conventional configurations do not allow the tamper-evident ring to slip, or rotate, around the container neck as the closure is unscrewed. As such, conventional configurations of this type require the multiple frangible bridges to be broken simultaneously as the closure is initially unscrewed. Simultaneous breakage of all frangible bridges, as required by conventional configurations, requires an undesirable amount of initial user-applied torque for opening the container.

Containers for storing some consumable materials, such as nutritional formula or dietary supplements, are typically sealed with a cap, or closure, to prevent contamination and/or leakage of the stored product. In many applications, containers are filled with the stored product prior to sealing the closure on the container. In some conventional applications, the filled container and closure together are subjected to a sterilization and sealing, or retort, process wherein heat and/or pressure are applied to the exterior of a pre-filled container and closure. Many conventional container configurations allow the container to rotate relative to the closure during the retort process. Such rotation, or "backoff," is undesirable and may affect the seal integrity and/or the sterilization of the container and the stored product. To prevent possible backoff during retort processing, some conventional containers include one or more ratchet teeth positioned on the container neck. The ratchet teeth typically engage mating ring teeth on the tamper-evident ring. The ring teeth slide, or ratchet, past the ratchet teeth when the closure is initially screwed onto the container for the first time. The ring teeth subsequently engage the ratchet teeth when the closure is unscrewed, thereby preventing reverse angular rotation of the tamper-evident ring and "locking" the tamper-evident ring relative to the container during the retort process.

While conventional ratchet teeth container configurations may prevent rotation between the closure and the container during retort processing, such configurations also require excessive amounts of user-applied removal torque for breaking the frangible bridges that connect the tamper-evident ring to the closure.

Thus, there is a continuing need in the art for improvements in various aspects of containers, closures and container systems of the types discussed above.

BRIEF SUMMARY

One aspect of an embodiment of the present disclosure provides a container for use with a closure having a frangible tamper-evident ring attached to the closure. The container includes a container body and a neck, and the neck defines a container thread. An annular rim protrudes from the neck below the container thread, and a ramp extends from the neck below the annular rim. The ramp includes a first inclined ramp surface oriented at a first ramp angle and a second inclined ramp surface oriented at a second ramp angle. Each ramp angle is measured relative to a reference axis oriented substantially perpendicular to a radial axis. The first and second ramp angles are each between about five degrees and about forty-five degrees.

Another aspect of an embodiment of the present disclosure provides a container system for storing material. The container system includes a container and a closure having a cap and a tamper-evident ring. The tamper-evident ring is frangibly attached to the cap, and the tamper-evident ring includes at least one ring tooth protruding radially inward. The container has a neck defining an opening in the container. The neck includes a container thread. A first ramp protrudes from the neck below the container thread. The first ramp includes first and second inclined ramp surfaces. The first inclined ramp surface is oriented at a first ramp angle relative to a first local reference axis, and the second inclined surface oriented at a second ramp angle relative to a second local reference axis. In some embodiments, the first and second ramp angles are each between about five degrees and about forty-five degrees.

Yet another aspect of an embodiment of the present disclosure provides a container for storing a consumable material such as a nutritional composition or a dietary supplement, for example but not limited to infant formula. The container includes a container body including a neck, and the neck defines a neck surface. A tamper-evident closure is attached to the container. The closure includes a tamper-evident ring frangibly attached to the closure. A container thread extends from the neck surface and engages the closure. An annular rim extends from the neck surface below the container thread and engages the tamper-evident ring. A closure-retaining structure extends from the neck surface below the container thread. The closure-retaining structure includes a first inclined ramp surface oriented at a first ramp angle and a second inclined ramp surface oriented at a second ramp angle. The first and second ramp angles are each between about five degrees and about forty-five degrees relative to a local reference axis.

Yet another embodiment of the present disclosure provides a container system for storing material. The system includes a container body having a neck, the neck including an uninterrupted cylindrical neck surface. A closure engages the neck. The closure includes a tamper-evident ring having a plurality of ring teeth protruding radially inward. The plurality of ring teeth resiliently engage the uninterrupted cylindrical neck surface in an interference fit.

A further aspect of the present disclosure provides a container system for storing materials including a container having a neck, the neck including a container thread. An annular bead protrudes from the neck below the container thread. A composite closure is disposed on the container. The composite closure includes an annular closure band and a closure disk. The closure disk has an annular outer rim, and the annular outer rim includes a lower disk edge. A tamper-evident ring is frangibly attached to the composite closure by a plurality of frangible bridges, each frangible bridge having a maximum bridge elongation defined as the maximum axial elongation the bridge can withstand before rupturing. The tamper-evident ring engages the annular bead during closure removal. A disk retainer bead protrudes radially inward from the closure band. The disk retainer bead defines a maximum disk travel distance between the lower disk edge and the disk retainer bead when the closure is fully-seated on the container. The maximum disk travel distance is greater than the maximum bridge elongation.

Yet another embodiment of the present disclosure provides a method of sealing a container using a tamper-evident container system. The method comprises the steps of:

(a) providing a container having a neck with an annular rim protruding from the container neck, wherein the annular rim engages a tamper-evident ring frangibly attached to a mating closure by a plurality of frangible bridges;

(b) attaching the closure to the neck so that the tamper-evident ring engages the annular rim, wherein the closure provides a releasable annular seal between the neck and the closure; and (c) removing the closure from the neck such that each one of the plurality of frangible bridges is broken before the annular seal is released.

Yet another aspect of the present disclosure provides a method of preparing a container system. The method includes the step of: (a) providing a container including a neck, the neck including an uninterrupted cylindrical neck surface, and a closure engaging the neck, the closure including a tamper-evident ring having a plurality of ring teeth protruding radially inward. The plurality of ring teeth resiliently engages the uninterrupted cylindrical neck surface in an interference fit. The method also includes the steps of: (b) attaching the closure to the neck; and (c) subjecting the container to a retort sterilization process.

Numerous other objects, features and advantages of the present disclosure will be readily apparent to those skilled in the art upon a reading of the following description when taken in conjunction with the accompanying drawings.

DETAILED DESCRIPTION

Figure 1:
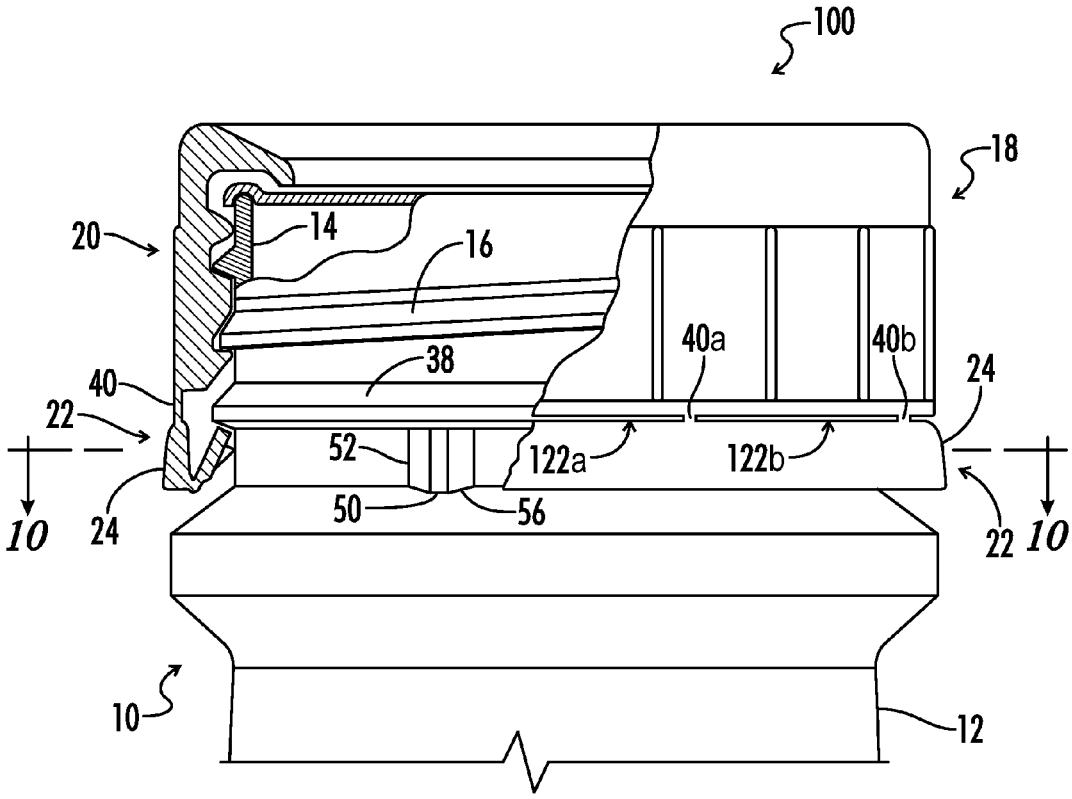
FIG. 1 illustrates a partially broken-away elevation view of one embodiment of a container system.

Referring now to the drawings and particularly to FIG. 1, a partially broken-away view of one embodiment of a container system is generally shown and is designated by the numeral 100. In the drawings, not all reference numbers are included in each drawing, for the sake of clarity. In addition, positional terms such as "upper," "lower," "side," "top," "bottom," "vertical," "horizontal," etc. refer to the container when in the orientation shown in the drawing. The skilled artisan will recognize that containers, closures and container systems in accordance with the present disclosure can assume different orientations when in use, or during handling, shipping or retort processing.

As seen in FIG. 1, a container system 100 includes a container 10 and a mating closure 18. Closure 18 in some embodiments includes a cap 20 and a tamper-evident ring 22. Tamper-evident ring 22 is frangibly attached to cap 20 by a plurality of frangible bridges 40*a*, 40*b*, etc., generally indicated by reference numeral 40. Each frangible bridge 40 is separated by a notch 122*a*, 122*b*, etc. defined in closure 18 between cap 20 and tamper-evident ring 22. In some embodiments, each frangible bridge 40 is formed by cutting, or scoring, multiple notches 122*a*, 122*b*, etc. in closure 18. Tamper-evident ring 22 generally remains on container 10 after the initial removal of cap 18 by a consumer or user. Tamper-evident ring 22 allows a consumer or user to inspect container system 100, and specifically frangible bridges 40 prior to purchase or use to determine if the container system 100 has been previously opened or damaged. A previously opened or damaged container system 100, as indicated by breakage of one or more frangible bridges 40, indicates the container seal may have been compromised and the stored product may be unsafe for consumption.

Frangible bridges 40 are generally dimensioned such that each frangible bridge 40*a*, 40*b*, etc. is ruptured when cap 20 is unscrewed from container 10.

Figure 2:
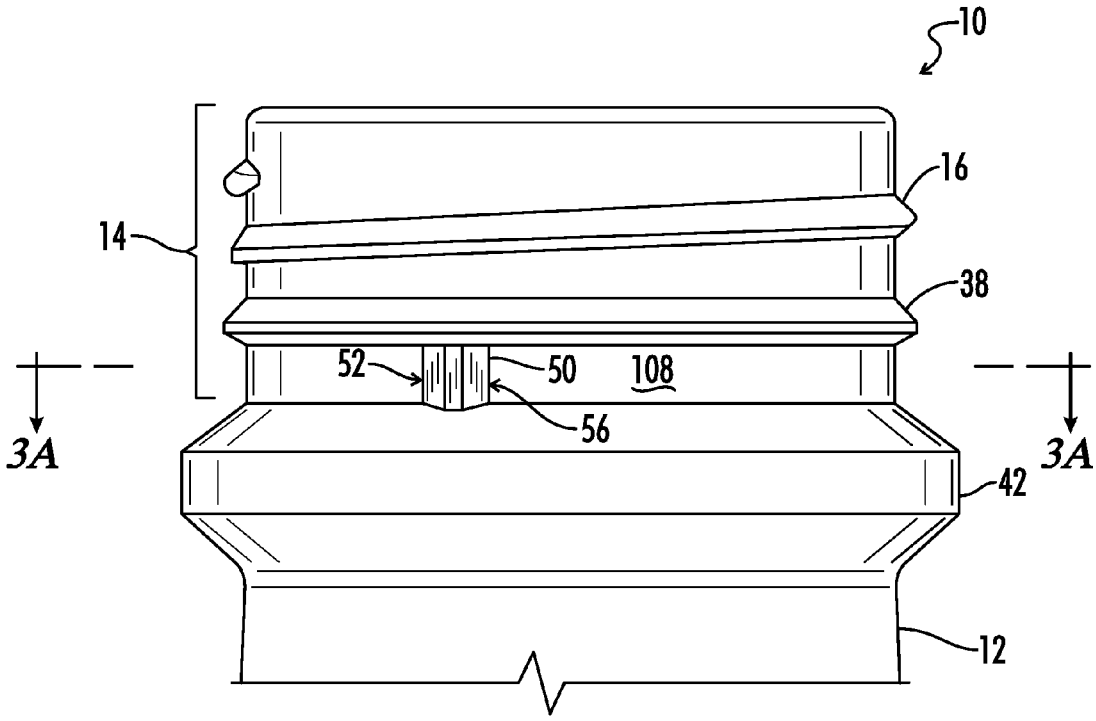
FIG. 2 illustrates a partial elevation view of one embodiment of a container.

Referring now to FIG. 2, container 10 includes a container body 12 and a container neck, or finish 14. Neck 14 in some embodiments defines a neck surface 108 having a substantially cylindrical shape. An annular bead, or annular rim 38, protrudes outwardly from neck surface 108 around the perimeter of neck 14. Annular rim 38 is generally positioned below a container thread 16. Container thread 16 is shaped to engage a mating closure thread disposed on cap 20, as seen in FIG. 1. When closure 18 is unscrewed from container 10, cap 20 moves axially away from container 10, causing annular rim 38 to engage tamper-evident ring 22. Axial movement of tamper-evident ring 22 is restricted by annular rim 38. As cap 20 continues to move axially away from container 10 during rotation of closure 18, an axial tension force is applied to each frangible bridge 40*a*, 40*b*, etc. The axial tension force applied to individual frangible bridges 40*a*, 40*b*, etc. can vary at different angular positions around the perimeter of tamper-evident ring 22, due, inter alia, to the upward slope of container thread 16. Variation in axial tension force is due to several factors, including for example closure thread geometry, container thread geometry, and closure and container material composition. Frangible bridges 40 break in a sequential (one at a time) or a semi-sequential (two or more, but less than all at a time) manner due to both angular variation in axial tension and the ability of the tamper-evident ring 22 to rotate, or slip, around neck 14 during closure 18 rotation. Sequential or semi-sequential breakage of frangible bridges 40 allows a relatively lower removal torque to be applied by the user for unscrewing cap 20 from container 10, as compared to conventional configurations which require simultaneous bridge breakage and a higher removal torque.

Container 10 is generally supplied to a consumer prepackaged with a stored consumable product, such as a food, beverage or nutritional composition, stored in container 10. The stored product in some applications is a nutritional composition intended for infants. During use, closure 18 can be removed from container 10 and replaced with a different closure, or cap, such as a feeding port or a feeding nipple, thereby transforming container body 12 into a feeding container such as a bottle. In some applications, a single user may manually remove and replace multiple closures 18 on numerous separate containers 10 several times each day.

In many applications, container 10 of the present disclosure can be filled with stored product prior to sealing closure 18 onto container 10. After the desired product is inserted, or filled, into container 10, closure 18 is positioned on container 10 and sealed in place. Generally, a filled container 10 can be sterilized using a retort process after filling. During the retort process, the container 10 and stored product are subjected to heat and/or pressure in a retort apparatus, such as but not limited to an oven, an autoclave or a thermal bath.

During retort processing, it is desirable for closure 18 to be retained on container 10 and to prevent angular rotation of container 10 relative to closure 18. As seen in FIG. 2, container 10 in some embodiments includes a first closure-retaining structure, or first ramp 50, positioned on neck 14 extending from neck surface 108. Generally, first ramp 50 engages tamper-evident ring 22, seen in FIG. 1 and FIG. 10, to prevent angular rotation of closure 18 relative to container 10 during retort processing. Similarly, first ramp 50 may also prevent angular rotation of closure 18 relative to container 10 during shipping, handling or other packaging or distribution processes. Typically, the applied torque experienced between closure 18 and container 10 during retort processing or other shipping and handling processes is less than the user-applied removal torque necessary for manually removing closure 18 from container 10. For example, in some embodiments, the typical applied torque experienced during retort processing, packaging, shipping or handling is less than about four inch-pounds, or about 0.5 Newton-meters. Thus, first ramp 50 engages tamper-evident ring 22 in some embodiments to prevent rotation of closure 18, and more particularly to prevent rotation of tamper-evident ring 22, relative to container 10 during a first range of applied torque, such as that experienced during retort processing.

When the applied torque exceeds a first range, for example when closure 18 is manually unscrewed from container 10, tamper-evident ring 22 rotates, or slips, over first ramp 50. First ramp 50 includes an inclined shape that allows tamper-evident ring 22 to slip past ramp 50 when a sufficient amount of removal torque is applied by the user. In some embodiments, the removal torque, experienced during manual removal of cap 20 is greater than about four inch-pounds.

Figure 3A:
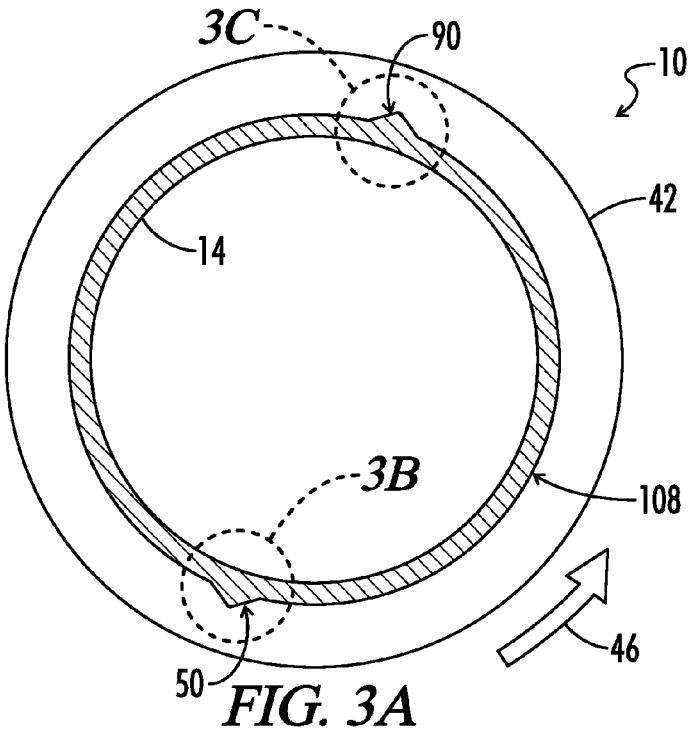
FIG. 3A illustrates a cross-sectional view of Section 3A-3A from FIG. 2 showing one embodiment of a container.
Figure 3B:
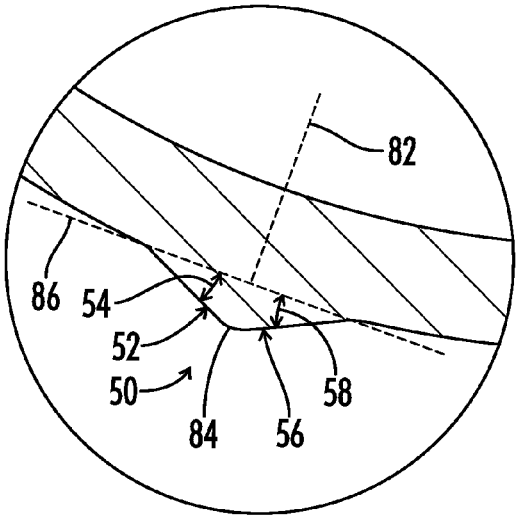
FIG. 3B illustrates a detail partial cross-sectional view of one embodiment of the container of FIG. 3A.

In a first embodiment, first ramp 50 can be integrally formed, or integrally molded, on container 10. Referring now to FIGS. 3A and 3B, in some embodiments first ramp 50 includes a first inclined ramp surface 52 and a second inclined ramp surface 56. First inclined ramp surface 52 is oriented at a first inclined ramp angle 54 relative to a first local reference axis 86. First local reference axis 86 is generally defined perpendicular to a first radial axis 82 extending in the radial direction. First radial axis 82 is angularly aligned with the first ramp apex 84, defining the outermost position on first ramp 50. Second inclined ramp surface 56 is oriented at a second inclined ramp angle 58 relative to first local reference axis 86. First inclined ramp surface 52 generally faces opposite the direction of applied removal torque 46, seen in FIG. 3A. In some embodiments, ramp 50 has a generally triangular profile, as seen in FIG. 3B. In some other embodiments, ramp 50 can have a rounded first ramp apex 84 at the intersection of the first and second inclined ramp surfaces 52, 56. In some embodiments, the first ramp apex 84 has a radius between about 0.025 and about 0.075 inches.

First and second ramp angles 54, 58 are generally less than ninety degrees. In some embodiments, first and second inclined ramp angles 54, 58 are each between about five degrees and about forty-five degrees. In yet other embodiments, first and second inclined ramp angles 54, 58 are each between about fifteen degrees and about thirty-five degrees. In further embodiments, first and second inclined ramp angles are substantially equal and are each about twenty-five degrees. As such, first and second ramp angles 54, 58 allow tamper-evident ring 22 to rotate, or slip, over ramp 50 both during application of closure 18 onto container 10 and during removal of closure 18. First ramp 50 is operative to engage tamper-evident ring 22 to prevent angular rotation of closure 18 relative to container 10 during retort processing, wherein the applied torque is less than the necessary removal torque experienced during closure removal.

Figure 3C:
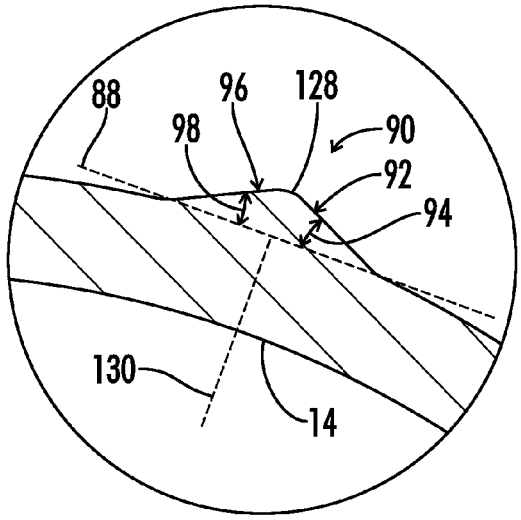
FIG. 3C illustrates a detail partial cross-sectional view of one embodiment of the container of FIG. 3A.

As seen in FIG. 3A, in some embodiments, a second closure-retaining structure, or second ramp 90 protrudes from neck 14. In some embodiments, second ramp 90 is located at an angular position diametrically opposite first ramp 50. Referring now to FIG. 3C, one embodiment of a second ramp 90 is illustrated in detail. Second ramp 90 includes a third inclined ramp surface 92 oriented at a third inclined ramp angle 94, and a fourth inclined ramp surface 96 oriented at a fourth inclined ramp angle 98. Each third and fourth inclined ramp angles 94, 98 are measured relative to a second local reference axis 88. Second local reference axis 88 is defined substantially perpendicular to a second radial axis 130 oriented in the radial direction. Second radial axis 130 is angularly aligned with second ramp apex 128. In some embodiments, third and fourth inclined ramp angles 94, 98 are chosen such that both third and fourth inclined ramp angles allow tamper-evident ring 22 to rotate, or slip, past second ramp 90 both during application of closure 18 onto container 10 and during manual removal of cap 20 from container 10. In some embodiments, third and fourth inclined ramp angles 94, 98 are each between about five degrees and about forty-five degrees. In some other embodiments, third and fourth inclined ramp angles are each between about fifteen degrees and about thirty-five degrees. In a further embodiment, third and fourth inclined ramp angles 94, 98 are equal and are each about twenty-five degrees.

Figure 4:
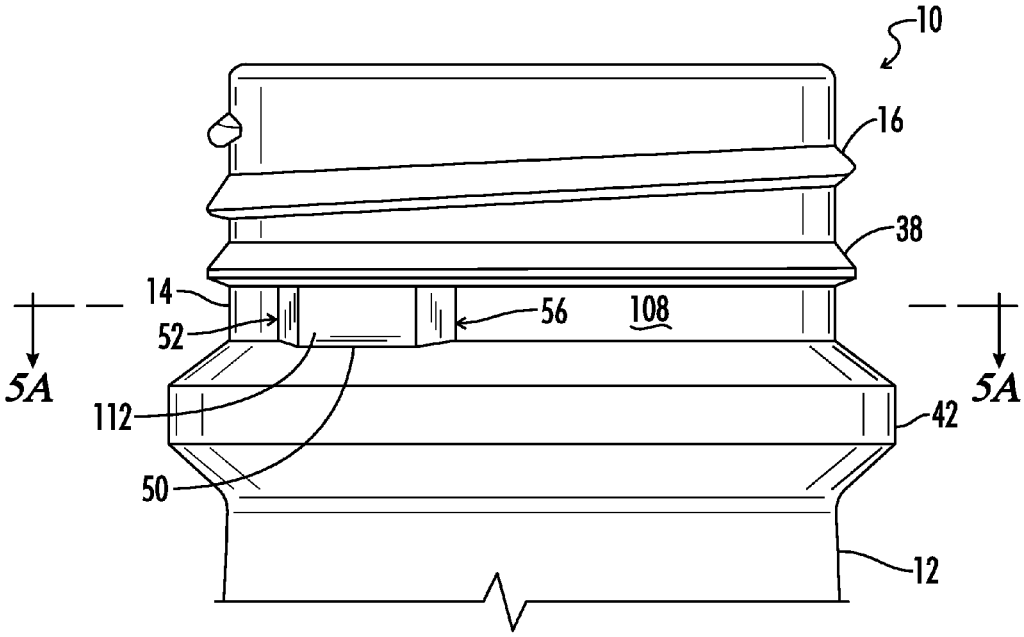
FIG. 4 illustrates a partial elevation view of one embodiment of a container.
Figure 5A:
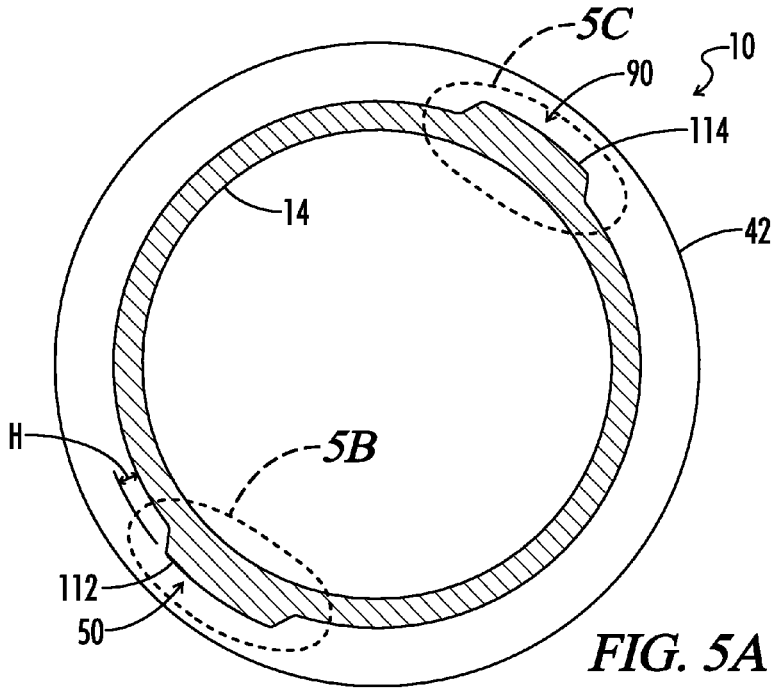
FIG. 5A illustrates a cross-sectional view of Section 5A-5A from FIG. 4 showing one embodiment of a container.
Figure 5B:
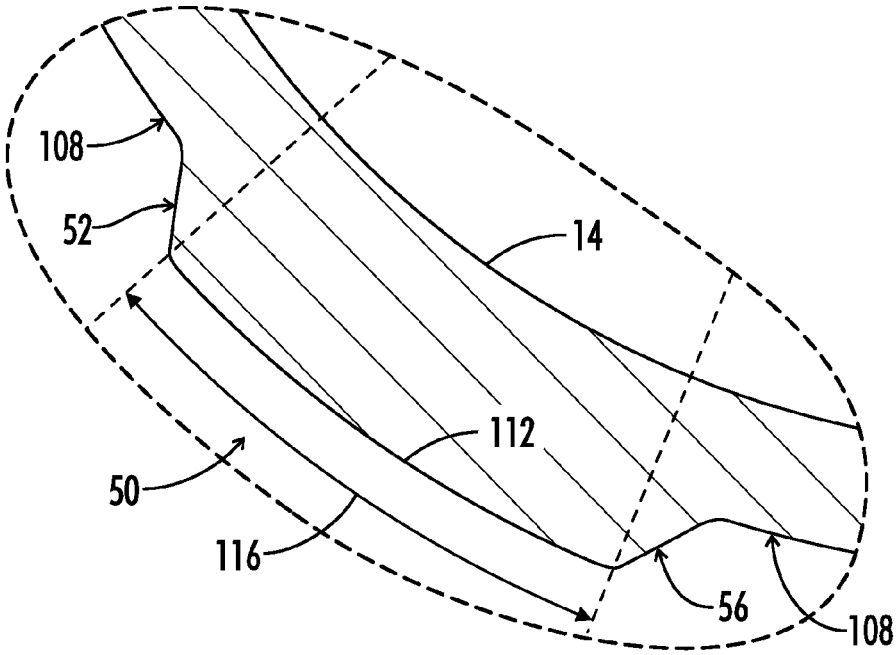
FIG. 5B illustrates a detail partial cross-sectional view of one embodiment of the container of FIG. 5A.
Figure 5C:
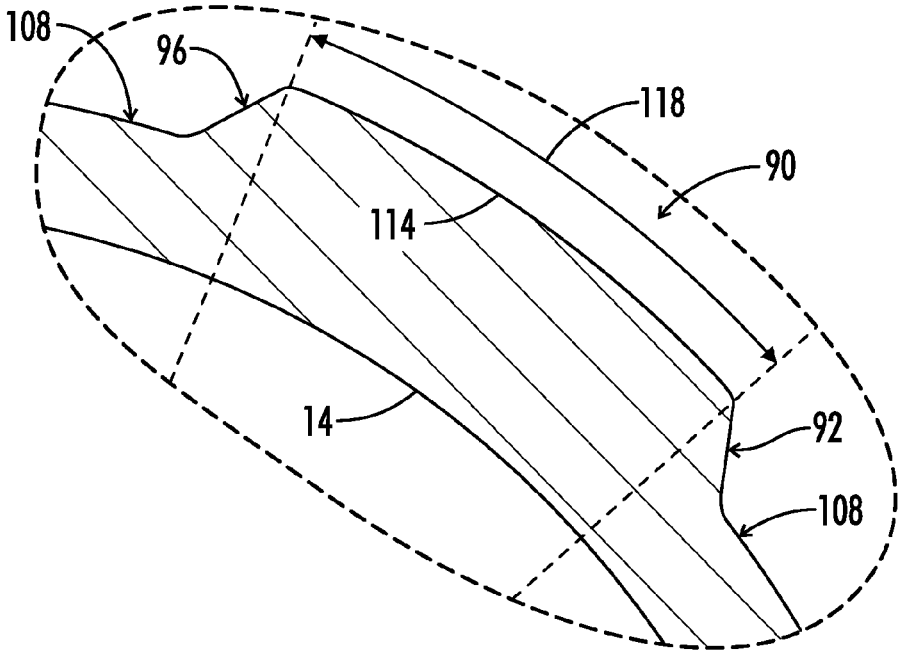
FIG. 5C illustrates a detail partial cross-sectional view of one embodiment of the container of FIG. 5A.

In another embodiment, referring now to FIG. 4, first ramp 50 includes a first extended region, or first plateau 112, extending between first and second inclined ramp surfaces 52, 56. FIG. 5A illustrates a cross-sectional view of one embodiment of a container 10 indicated at Section 5A-5A from FIG. 4. As seen in FIG. 5A, first plateau 112 in some embodiments defines the maximum distance H that first ramp 50 extends from neck surface 108. As seen in more detail in FIG. 5B, in some embodiments, first plateau 112 extends along the outer perimeter of neck surface 108 a first angular distance 116 of between about twenty degrees and about forty-five degrees. In yet another embodiment, first plateau 112 extends a first angular distance 116 of about thirty degrees. As seen in FIGS. 5A and 5C, in some embodiments, a second extended region, or second plateau 114, is positioned on second ramp 90 between third and fourth inclined ramp surfaces 92, 96. In some embodiments, second plateau 114 is located diametrically opposite first ramp 50. As seen in more detail in FIG. 5C, second plateau 114 in some embodiments extends along the outer perimeter of neck 14 a second angular distance 118 of between about twenty degrees and about forty-five degrees. In yet another embodiment, second plateau 114 extends a second angular distance 118 of about thirty degrees. In some applications, first and/or second plateaus 112, 114 provide, inter alia, an anti-squeeze structure that prevents closure 18 and/or tamper-evident ring 22 from compressing, or squeezing, radially inward and locally deforming the tamper-evident ring.

Figure 6:
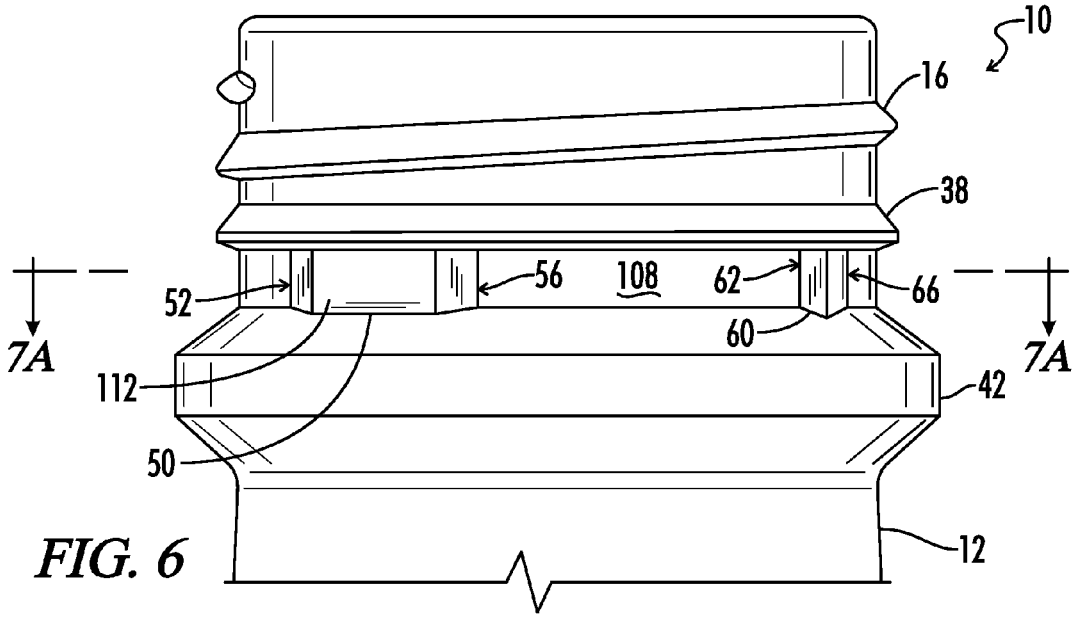
FIG. 6 illustrates a partial elevation view of one embodiment of a container.
Figure 7A:
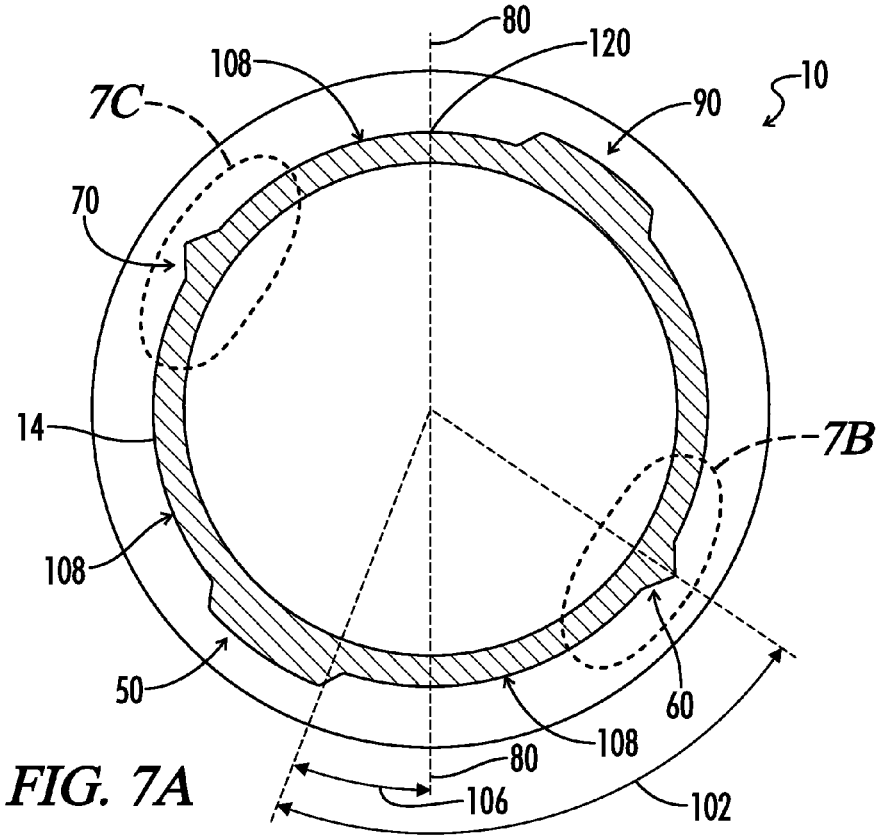
FIG. 7A illustrates a cross-sectional view of Section 7A-7A from FIG. 6 showing one embodiment of a container.
Figure 7B:
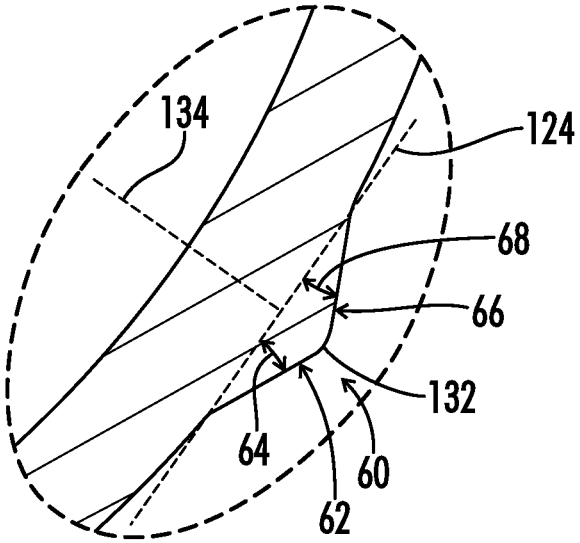
FIG. 7B illustrates a detail cross-sectional view of one embodiment of the container of FIG. 7A.

In still another embodiment, referring now to FIG. 6 and FIG. 7A, container 10 includes a first ramp 50 extending from neck surface 108. A second ramp 90 extends from neck surface 108 diametrically opposite first ramp 50. A third closure-retaining structure, or third ramp 60, also extends from neck surface 108 between first and second ramps 50, 90. Third ramp 60 includes a fifth inclined ramp surface 62 and a sixth inclined ramp surface 66, as seen in FIG. 7B. Fifth inclined ramp surface 62 is oriented at a fifth inclined ramp angle 64 relative to third local reference axis 124, wherein third local reference axis 124 is oriented substantially perpendicular to a third radial axis 134. Third radial axis 134 is defined in the radial direction and is angular aligned with third ramp apex 132. Similarly, sixth inclined ramp surface 66 is oriented at a sixth inclined ramp angle 68 relative to third local reference axis 124. In the embodiment seen in FIG. 7A, third ramp 60 is located between first and second ramps 50, 90 and is angularly offset from first ramp 50 by a first offset angle 102. In some embodiments, first offset angle 102 is between about seventy degrees and about eighty degrees. In yet another embodiment, first offset angle 102 is about seventy-five degrees.

Figure 7C:
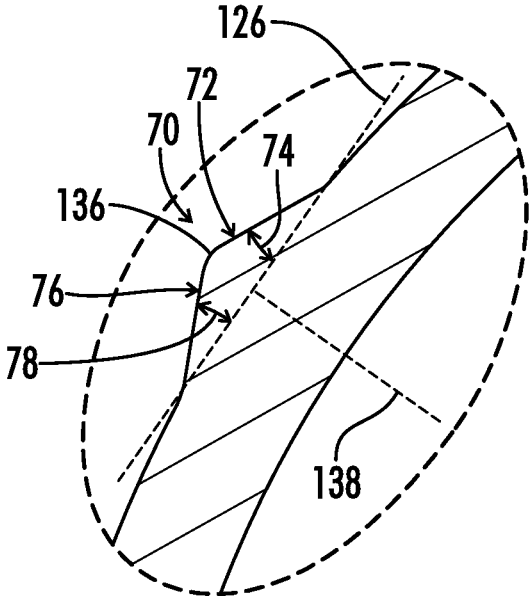
FIG. 7C illustrates a detail cross-sectional view of one embodiment of the container of FIG. 7A.

Referring to FIG. 7A and FIG. 7C, in some embodiments, container 10 includes a fourth closure-retaining structure, or fourth ramp 70, extending from neck surface 108. Fourth ramp 70 includes a seventh inclined ramp surface 72 oriented at a seventh inclined ramp angle 74. Fourth ramp 70 also includes an eighth inclined ramp surface 76 oriented at an eighth inclined ramp angle 78. Seventh and eighth inclined ramp angles 74, 78 are each measured relative to a fourth local reference axis 126. Fourth local reference axis 126 is defined perpendicular to a fourth radial axis 138 oriented in the radial direction. Fourth radial axis 138 is angularly aligned with fourth ramp apex 136. In some embodiments, fourth ramp 70 is angularly positioned on container 10 diametrically opposite third ramp 60.

Also seen in FIG. 7A, in some embodiments, a reference thread start axis 80 extends through a full thread angular position 120 corresponding to the beginning of a full thread profile on container thread 16, seen in FIG. 1. In some embodiments, full thread angular position 120 is generally positioned opposite first ramp 50. In one embodiment, the first ramp 50 is angularly offset from the thread start axis 80 by a second offset angle 106, as seen in FIG. 7A. In some embodiments, second offset angle 106 is between about ten degrees and about thirty degrees. In yet other embodiments, a second offset angle 106 of about twenty degrees provides the desired closure-retaining function for retaining the closure on the container during retort processing.

Figure 8:
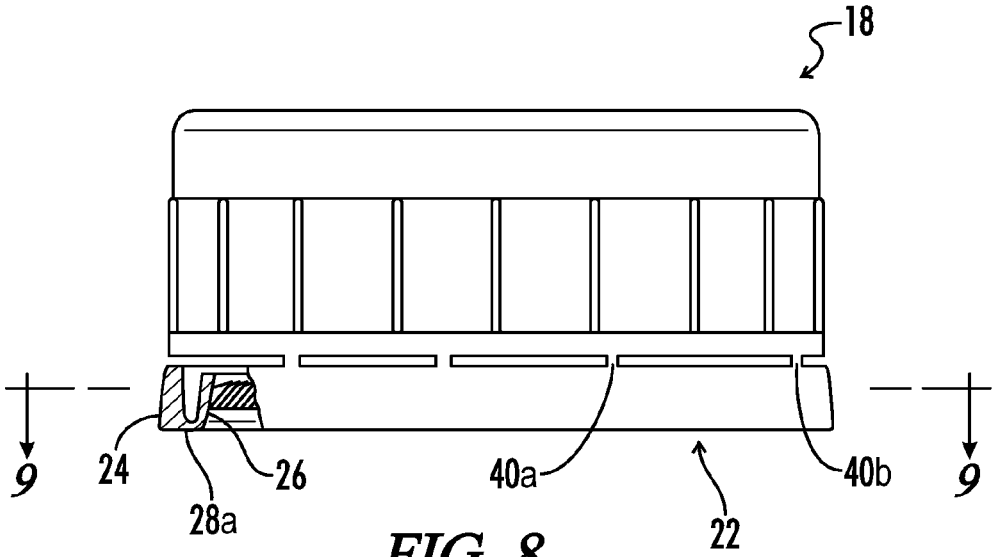
FIG. 8 illustrates a partially broken-away view of one embodiment of a closure.
Figure 9:
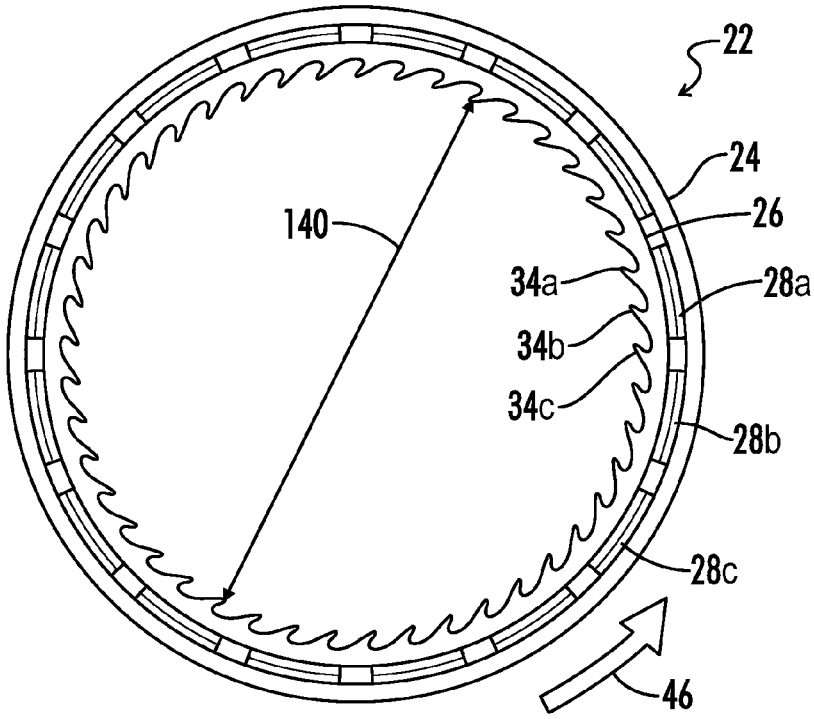
FIG. 9 illustrates a partial cross-sectional view of one embodiment of a closure showing Section 9-9 from FIG. 8.

Referring now to FIG. 8, one embodiment of closure 18 is generally illustrated. Closure 18 includes a tamper-evident ring 22 having an outer ring 24 and an inner ring 26. Referring now to FIG. 9, a partial cross-sectional view of Section 9-9 from FIG. 8 generally illustrates one embodiment of a tamper-evident ring 22. Tamper-evident ring 22 includes an inner ring 26 having a plurality of ring teeth 34*a*, 34*b*, 34*c*, etc., collectively referred to as ring teeth 34, protruding radially inward from inner ring 26. Each ring tooth 34 is generally angled toward the direction of applied removal torque 46.

Ramp Interference Ratio

Figure 10:
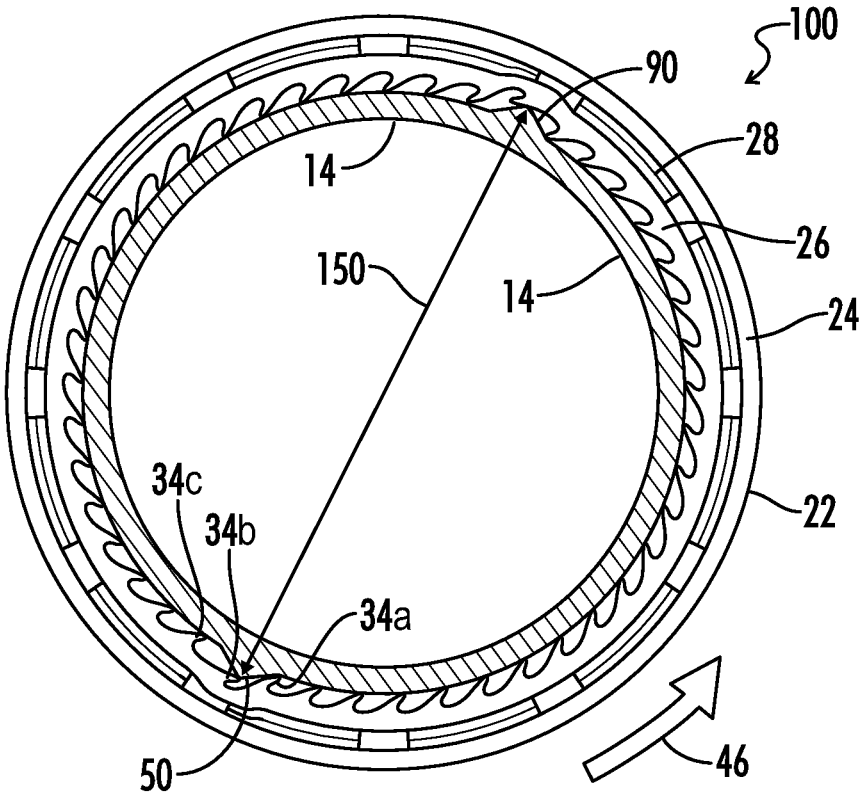
FIG. 10 illustrates a partial cross-sectional view of one embodiment of a container system showing Section 10-10 from FIG. 1.

A ramp interference ratio is defined as ramp diameter 150, seen in FIG. 10, divided by ring diameter 140, seen in FIG. 9. Tamper-evident ring 22 defines a ring diameter 140, seen in FIG. 9, spanning the shortest inner diameter of tamper-evident ring 22. Ring diameter 140 in some embodiments is defined between diametrically opposite ring teeth. Ring diameter 140 in some embodiments is an unrestrained ring diameter of inner ring 26 prior to placement of the closure 18 on neck 14. It is understood that a container having any of the closure-engaging structures, or ramps, described herein can be used with closures having other embodiments of tamper-evident rings known in the art but not shown, including tamper-evident rings having only one ring structure.

Referring now to FIG. 10, a cross-sectional view of Section 10-10 from FIG. 1 is generally illustrated showing tamper-evident ring 22 disposed on neck 14. In this embodiment, first ramp 50 engages second ring 26. More specifically, first ramp 50 engages one or more ring teeth 34*a*, 34*b*, 34*c*, etc. In some embodiments, second ramp 90 also engages second ring 26 and more particularly one or more ring teeth. As seen in FIG. 10, in some embodiments first and second ramps 50, 90 are located diametrically opposite on neck 14, and a ramp diameter 150 is defined as the outermost dimension of neck 14 engaging inner ring 26 extending from first ramp 50 to second ramp 90.

In some embodiments, ramp diameter 150 is greater than neck diameter 140, creating a ramp interference ratio between one or more ramps and inner ring 26. Thus, when the closure is placed on the container, the inner ring engages the neck, including the first, second, third and/or fourth ramps. Each ring tooth 34 in some embodiments resiliently protrudes radially inward from inner ring 26. As such, each ring tooth is compressed radially outward due to the ramp interference ratio being greater than 1.0. In some embodiments, a ramp interference ratio greater than 1.0 allows the neck, and particularly the one or more ramps, to radially compress the resilient ring teeth of the inner ring to provide an anti-backoff feature that prevents the closure from rotating relative to the container during relatively low-torque applications, for example during retort processing. In some embodiments, the inner ring is also radially compressed toward the outer ring by the ramps. However, the radial compression created by the ramp interference ratio is not great enough to prevent rotation of the closure relative to the container when a threshold amount of removal torque is applied to the closure. In some embodiments, the ramp interference ratio is between about 1.0 and about 1.2. In yet other embodiments, a ramp interference ratio of between about 1.02 and about 1.08 provides sufficient radial compression of inner ring 26 to prevent closure backoff during retort processing while also allowing the tamper-evident ring to rotate, or slip, relative to the container during manual closure removal.

Neck Interference Ratio

Figure 11A:
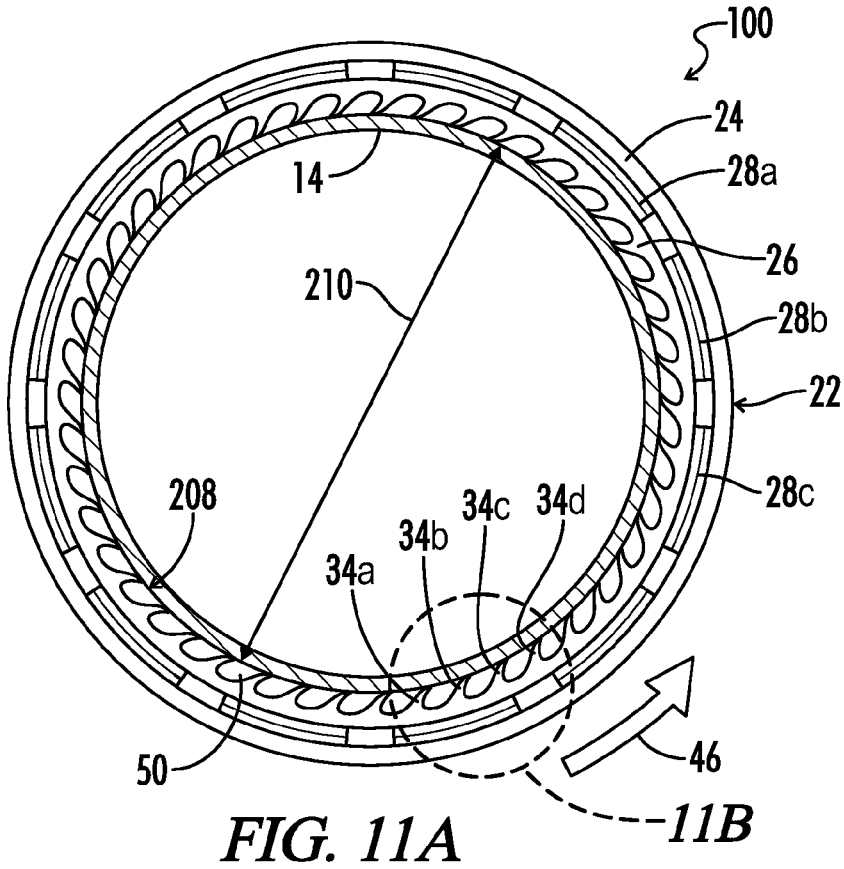
FIG. 11A illustrates a cross-sectional view of one embodiment of a container system.

A neck interference ratio is defined as neck diameter 210, seen in FIG. 11A, divided by ring diameter 140, seen in FIG. 9. Referring now to FIG. 11A, an alternative embodiment of a container system 100 in accordance with the present disclosure is illustrated in a cross-sectional view of a plane extending through the container neck 14 and tamper-evident ring 22 similar to the view illustrated in a different embodiment in FIG. 10. As seen in FIG. 11A, the tamper-evident ring 22 includes an outer ring 24 and an inner ring 26. The inner and outer rings 26, 24 are interconnected by a plurality of flexible hinges 28*a*, 28*b*, 28*c*, etc. Each flexible hinge 28 in some embodiments is integrally formed between inner and outer rings 26, 24. Inner ring 26 includes a plurality of ring teeth 34*a*, 34*b*, 34*c*, 34*d* etc. protruding radially inward from inner ring 26. Each one of the plurality of ring teeth 34 engages neck 14. In this embodiment, neck 14 defines an uninterrupted cylindrical neck surface 208 forming the shape of a cylinder. As used herein, the term "uninterrupted" refers to a neck surface 208 that is substantially uniform around its perimeter and includes no protruding structures for engaging the plurality of ring teeth 34. The plurality of ring teeth 34 generally engage uninterrupted cylindrical neck surface 208 in an interference fit. Neck 14 defines a neck diameter 210 corresponding to the outer diameter of neck 14. In this embodiment, neck diameter 210 corresponds to the outer diameter of uninterrupted cylindrical neck surface 208 and is substantially uniform. Neck diameter 210 in this embodiment is greater than inner ring diameter 140, as seen in FIG. 9. The container system 100 in this embodiment defines a neck interference ratio equal to the neck diameter 210 divided by the inner ring diameter 140, wherein the neck interference ratio is greater than 1.0. In some embodiments, neck interference ratio is between about 1.01 and about 1.10. In yet other embodiments, the neck interference ratio is between about 1.01 and about 1.04.

Figure 11B:
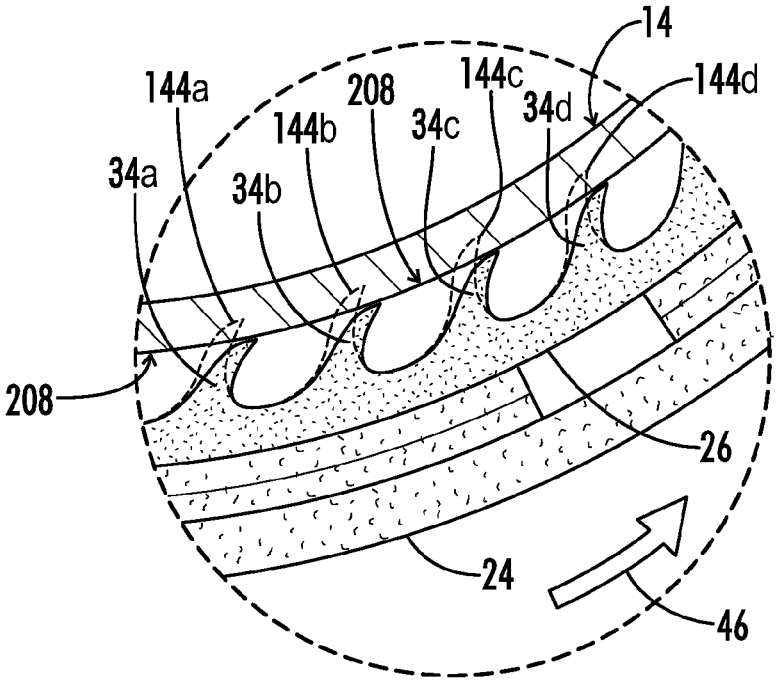
FIG. 11B illustrates a detail partial cross-sectional view of Section 11B from FIG. 11A.

In some embodiments of a container system 100 having a neck interference ratio greater than 1.0, tamper-evident ring 22 engages neck 14 in an interference fit made possible, inter alia, by the resiliency of ring teeth 34. As seen in one embodiment in FIG. 11B, ring teeth 34*a*, 34*b*, 34*c*, 34*d*, etc. are resiliently deflected from initial ring tooth positions 144*a*, 144*b*, 144*c*, 144*d*, etc. when inner ring 26 engages neck surface 208. As such, ring teeth 34 exert an inward radial clamping force against neck 14, and particularly against neck surface 208. In some embodiments, the inward radial clamping force exerted by ring teeth 34 against uninterrupted neck surface 208 around the perimeter of neck 14 is sufficient to prevent closure backoff, or rotation of closure 18 relative to container body 12, during processing or handling, including during retort sterilization processing. Additionally, by providing an uninterrupted neck surface 208 extending around the perimeter of neck 14 in the region engaged by ring teeth 34*a*, 34*b*, 34*c*, 34*d*, etc., the manual user-applied removal torque necessary for removal of cap 20 from container body 12 during container opening is further reduced. Reduction of the necessary manual user-applied removal torque provides a container system 100 that is easier to open. Also seen in FIG. 11B, each one of the plurality of ring teeth 34 in one embodiment are angled in the direction of applied removal torque 46. Angled ring teeth 34 are able to rotate, or slip, over neck surface 208 as closure 18 is manually rotated counter-clockwise when viewed from above, or unscrewed, from container 10, but also provide friction between neck surface 208 and tamper-evident ring 22 for preventing inadvertent closure backoff.

Disk Retainer Bead

Figure 12:
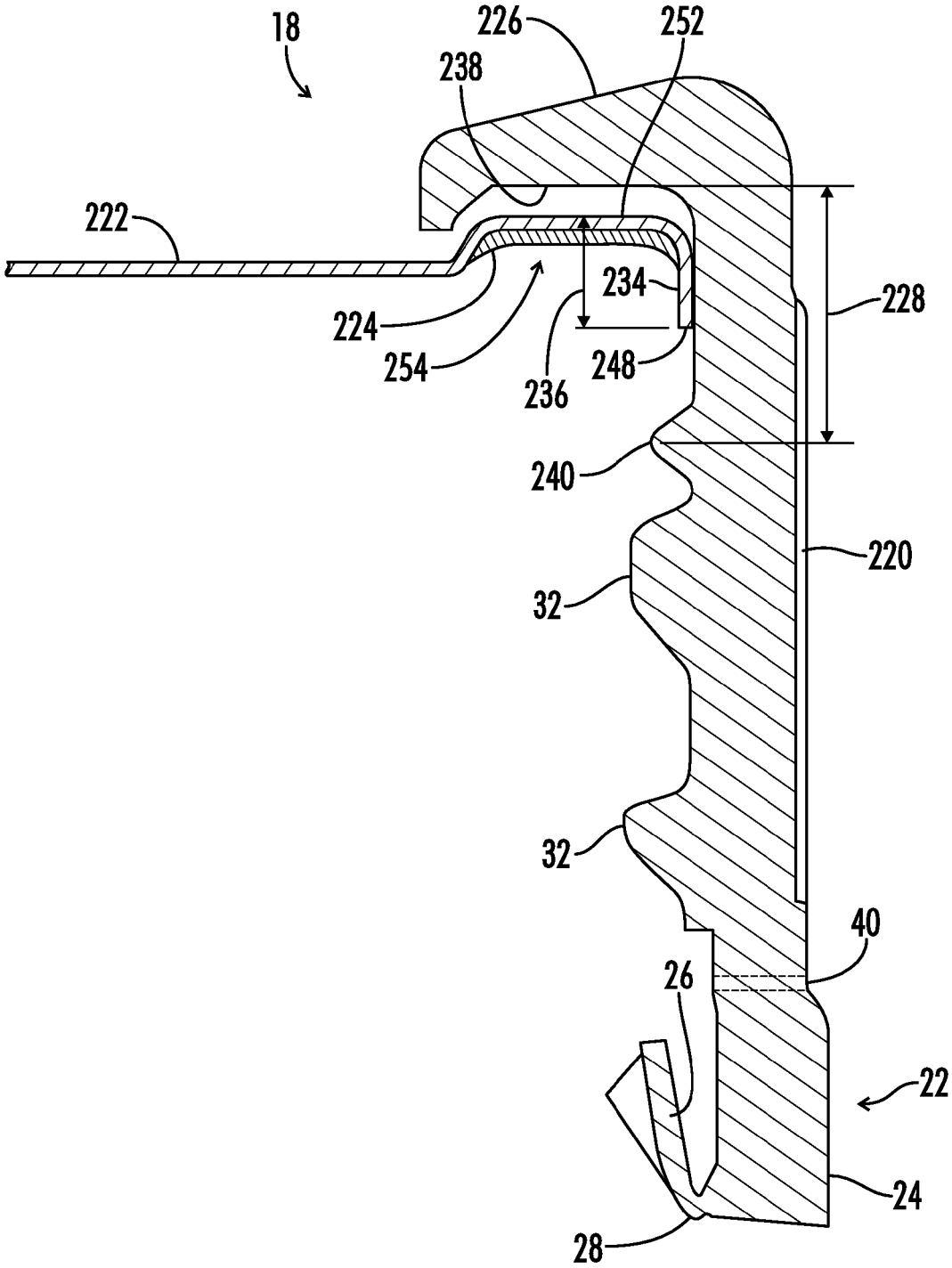
FIG. 12 illustrates a detail partial cross-sectional view of one embodiment of a composite closure.

Referring now to FIG. 12, one embodiment of closure 18 provides a composite closure having an annular closure band 220 and a closure disk 222. In some embodiments, closure disk 222 comprises a metal. In other embodiments, closure disk 222 can be a polymer or plastic material. As seen in FIG. 12, tamper-evident ring 22 extends generally downward from closure band 220 and is frangibly connected to closure band 220 by a plurality of frangible bridges 40. Tamper-evident ring 22 in some embodiments includes an inner ring 26 and an outer ring 24 interconnected by one or more hinges 28. In some embodiments, both inner ring 26 and outer ring 24 are made of a plastic or polymer material, for example an injection molded thermopolymer such as polypropylene, polystyrene, polyethylene or mixtures thereof, and hinge 28 is a living hinge integrally formed between inner and outer rings 26, 24.

As seen in FIG. 12, closure disk 222 includes an annular outer rim 234 having a lower disk edge 248 and defining a disk rim height 236. In some embodiments, closure disk 222 forms a disk bead 252 around the outer periphery of closure disk 222. Disk bead 252 forms a disk channel 254. A gasket, or sealant 224, is disposed in the disk channel 254 in some embodiments. Gasket 224 generally engages a container land 212 on neck 14 when closure 18 is attached to container 10 in a fully-seated position to form a releasable seal between container 10 and closure 18, as seen in FIG. 13A.

Figures 13A, 13B:
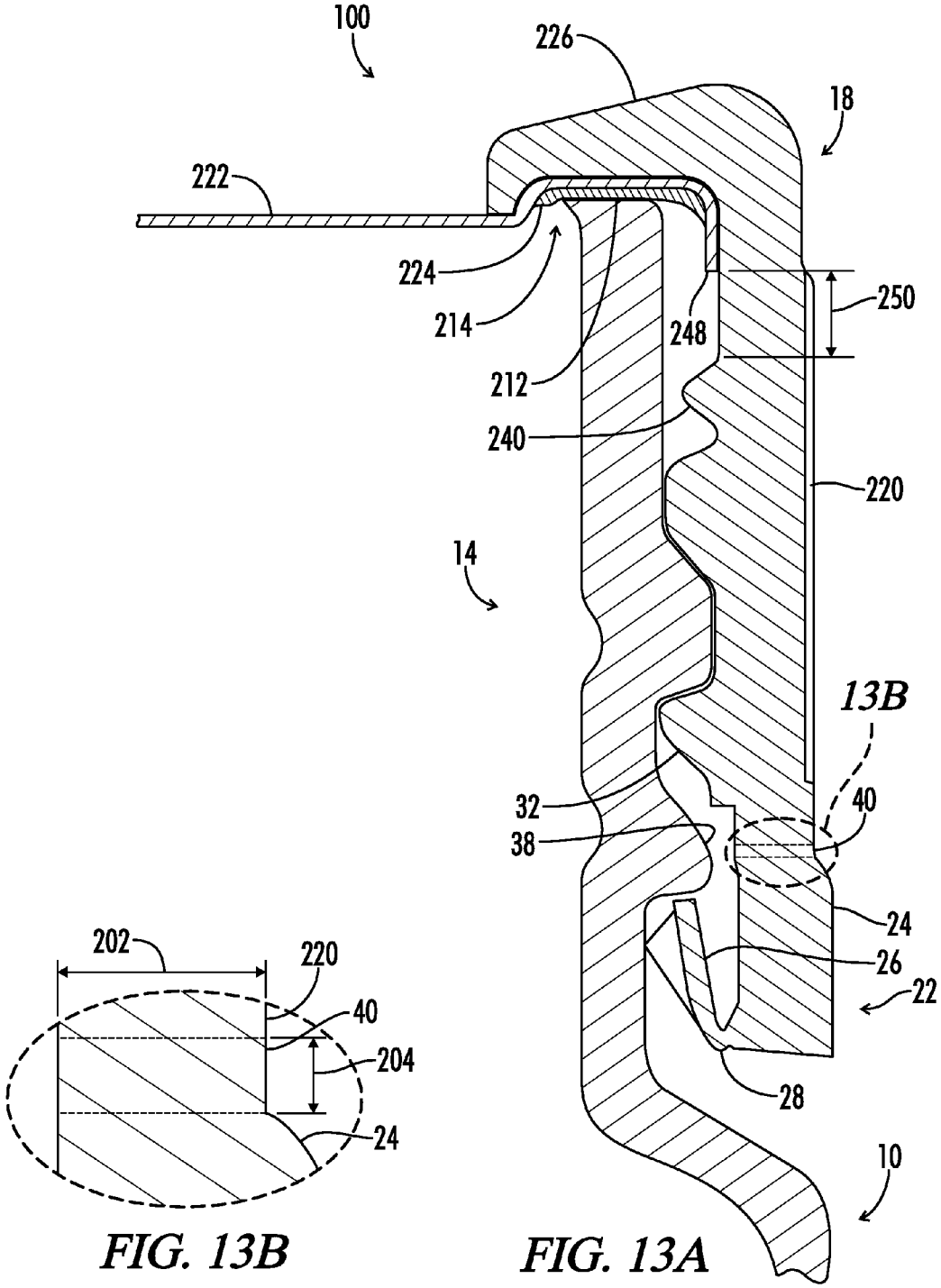
FIG. 13A illustrates a partial cross-sectional view of one embodiment of a container system.
FIG. 13B illustrates a detail partial cross-sectional view of Section 13B from FIG. 13A.
Figures 14A, 14B:
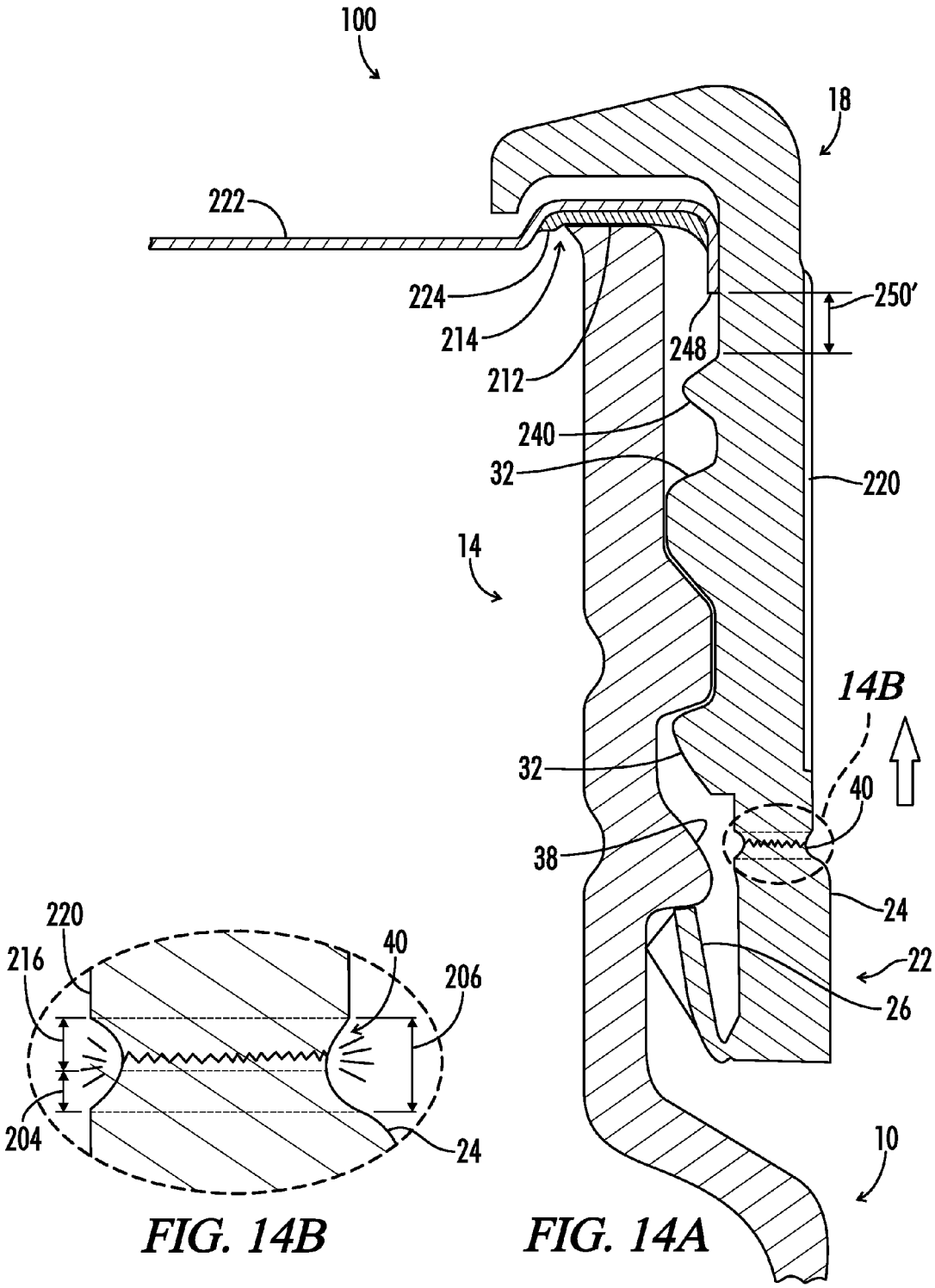
FIG. 14A illustrates a partial cross-sectional view of one embodiment of a container system.
FIG. 14B illustrates a detail partial cross-sectional view of Section 14B from FIG. 14A.

Referring to FIGS. 12, 13A and 14A, a closure band 220 includes a disk retainer bead 240 protruding radially inward from annular closure band 220. Disk retainer bead 240 may have a rounded profile or various other rectangular or curvilinear profiles not shown. Disk retainer bead 240 in some embodiments forms a continuous annular ring. It is understood that in other embodiments, disk retainer bead 240 can be segmented or may partially extend around the inner perimeter of closure band 220.

Closure band 220 also includes a closure band rim 226 protruding radially inward generally above closure disk 222 and disk retainer bead 240. Band rim 226 includes an underside 238, seen in FIG. 12, generally shaped to engage disk bead 252 on closure disk 222. A disk gap 228, seen in FIG. 12, is defined as the distance between underside 238 of band rim 226 and disk retainer bead 240. A maximum disk travel distance 250, seen in FIG. 13A, is defined as the distance between lower disk edge 248 and disk retainer bead 240 when closure 18 is in a fully-seated position such that disk bead 252 engages underside 238 of bead rim 226. An intermediate disk travel distance 250' less than maximum disk travel distance 250, seen in FIG. 14A, is generally measured between lower disk edge 248 and the position on disk retainer bead 240 that engages lower disk edge 248 as container band 220 rises on neck 14 during removal, or unscrewing, of closure 18.

Referring further to FIG. 13A, tamper-evident ring 22 is frangibly attached to closure band 220 by a plurality of frangible bridges 40. As seen in FIG. 13B, one embodiment of a frangible bridge 40 includes an initial bridge thickness 202 measured generally in the radial direction and an initial bridge height 204 measured generally in the axial direction. Initial bridge thickness 202 and initial bridge height 204 are generally the thickness and height of frangible bridge 40 prior to deformation, or elongation, of bridge 40 resulting from tensile and/or shear loading.

Referring now to FIG. 14A, as closure 18 is unscrewed from container 10, closure band 220 rises axially, and each one of the plurality of frangible bridges 40 is stressed axially in tension because tamper-evident ring 22 engages annular rim 38 and is thus prevented from rising contemporaneously with closure band 220. Consequentially, each frangible bridge 40 can experience mechanical bridge elongation, or axial deformation, due to tensile loading. In some embodiments, bridge elongation may result in bridge necking, as seen in FIG. 14A. In other embodiments, each frangible bridge 40 may undergo rough fracture with minimal elongation or necking. Each frangible bridge 40 eventually ruptures, fractures, or breaks, resulting in local separation of the tamper-evident ring 22 from closure band 220. It is understood that frangible bridges 40 in accordance with the present disclosure do not break simultaneously, but rather break sequentially or semi-sequentially as closure 18 rises axially due to engagement with the generally upwardly-angled container thread 16 disposed on neck 14.

As seen in FIG. 14B, bridge 40 experiences a maximum bridge height 206 at the moment of rupture, or fracture. Maximum bridge elongation 216 is substantially equal to maximum bridge height 206 minus original bridge height 204. The term "maximum bridge elongation" as used herein refers to the maximum length of axial deformation experienced by any single bridge 40 during closure removal. Maximum bridge elongation 216 is a function of, inter alia, geometric bridge dimensions and bridge material properties. In some embodiments, frangible bridge 40 includes an initial bridge height 204 between about five microns and about 500 microns, an initial bridge thickness 202 between about five microns and about 1.0 millimeter, and a bridge width between about five microns and about 1.0 millimeter and comprises a polymer or plastic. It is understood that maximum bridge elongation 216 experienced during axial loading of each bridge during cap removal can vary among individual bridges 40*a*, 40*b*, etc. on one closure. In some embodiments, the amount of bridge elongation 216 experienced during closure removal can be less than initial bridge height 204. In other embodiments, the amount of bridge elongation 216 experienced during closure removal can be greater than initial bridge height 204, as illustrated in one embodiment in FIG. 14B.

In some embodiments, maximum disk travel distance 250 when closure 18 is fully-seated on neck 14, as seen in FIG. 13A, is greater than the maximum bridge elongation 216 experienced by bridge 40 at the moment of rupture, seen in FIG. 14B. As such, all individual frangible bridges 40 rupture prior to engagement of lower disk edge 248 by disk retainer bead 240. In this embodiment, disk seal 214 remains intact until all frangible bridges 40 are broken. In further embodiments, the ratio of maximum disk travel distance to maximum bridge elongation is greater than about 1.1. In further embodiments, the ratio of maximum disk travel distance to maximum bridge elongation is between about 1.2 and about one-hundred. In some other embodiments, the ratio of maximum disk travel distance to maximum bridge elongate may exceed one-hundred, especially where bridge elongation is minimal. In yet other embodiments, the ratio of disk travel distance to maximum bridge elongation is configured so that each of the plurality of frangible bridges ruptures before the disk retainer bead engages the lower disk edge during closure removal. In some other embodiments, the maximum disk travel distance is between about 0.1 millimeters and about 3.0 millimeters.

Figure 15:
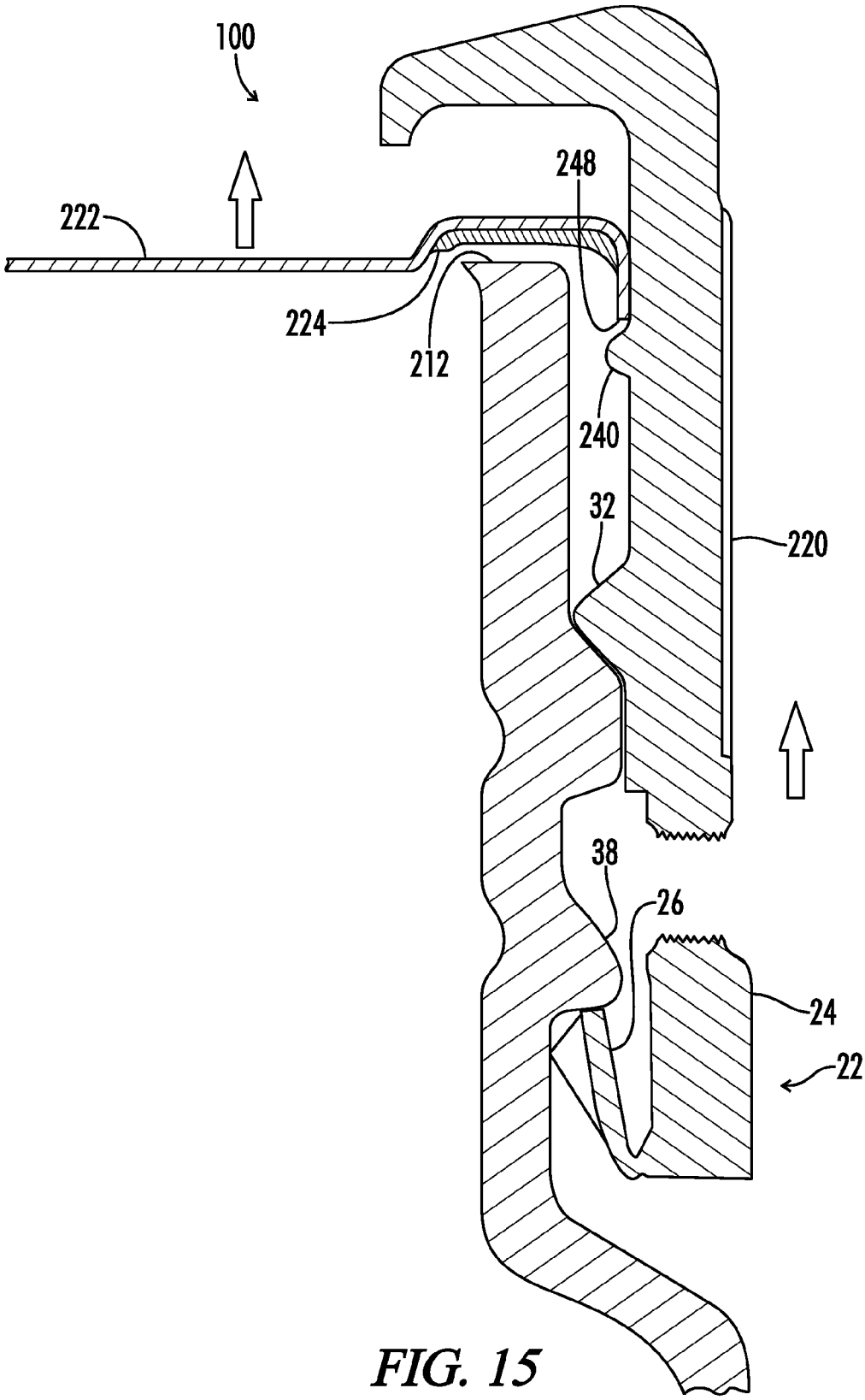
FIG. 15 illustrates a partially exploded cross-sectional view of one embodiment of a container system.

Referring now to one embodiment illustrated generally in FIG. 15, following rupture of all frangible bridges during closure removal, disk retainer bead 240 engages lower disk edge 248, causing closure disk 222 to "lift-off" from neck 14. During lift-off, gasket 224 disengages from container land 212 and disk seal 214 is broken. Also, during lift-off, friction between container land 212 and gasket 224 or closure disk 222 can increase removal torque necessary for removing closure from neck 14. In some embodiments, a vacuum or partial vacuum inside container 10 can further increase removal torque necessary for lifting closure disk 222 from neck 14 and disengaging first seal 214. By allowing all frangible bridges to break prior to lift-off, any increased removal torque associated with disk friction and/or seal disengagement is temporally and angularly separated from removal torque application necessary for bridge rupture.

Yet another embodiment of the present disclosure provides a method of sealing a container using a tamper-evident container system. The method comprises the steps of: (a)providing a container having a neck with an annular rim protruding from the container neck, wherein the annular rim engages a tamper-evident ring frangibly attached to a mating closure by a plurality of frangible bridges; (b) attaching the closure to the neck so that the tamper-evident ring engages the annular rim, wherein the closure provides a releasable annular seal between the neck and the closure; and (c) removing the closure from the neck such that each one of the plurality of frangible bridges is broken before the annular seal is released. In some embodiments, the closure band further comprises a disk retainer bead protruding radially inward from the closure band and engaging the closure disk; the closure disk further comprises a lower disk edge operative to engage the disk retainer bead during closure removal; and each one of the plurality of frangible bridges is broken before the lower disk edge engages the disk retainer bead. In additional embodiments, the closure defines a maximum disk travel distance equal to the maximum distance between the lower disk edge and the disk retainer bead when the closure is fully-seated on the container, wherein each one of the plurality of frangible bridges experiences bridge elongation during closure removal, and wherein the maximum bridge elongation is less than the maximum disk travel distance.

Thus, although there have been described particular embodiments of the present invention of a new and useful Tamper-Evident Container System, it is not intended that such references be construed as limitations upon the scope of this invention except as set forth in the following claims.

What is claimed is:

1. A container for use with a closure having a frangible tamper-evident ring, the container comprising:

a container body having a neck, the neck including an outer perimeter and a container thread;

an annular rim protruding from the neck below the container thread; and a first ramp protruding from the neck below the annular rim, the first ramp including a first inclined ramp surface oriented at a first inclined ramp angle and a second inclined ramp surface oriented at a second inclined ramp angle, wherein the first and second inclined ramp angles are each between about five degrees and about forty-five degrees relative to a first local reference axis, wherein the first local reference axis is oriented perpendicular to a radial axis.

2. The container of claim 1 wherein the first and second inclined ramp angles are each between about fifteen degrees and about thirty-five degrees relative to the first local reference axis.

3. The container of claim 1, further comprising:

a second ramp protruding from the neck below the annular rim, wherein the second ramp is located at an angular position diametrically opposite the first ramp the second ramp having a third inclined ramp surface oriented at a third inclined ramp angle; and the second ramp having a fourth inclined ramp surface oriented at a fourth inclined ramp angle, wherein the third and fourth inclined ramp angles are each between about five degrees and about forty-five degrees relative to a second local reference axis, wherein the second local reference axis is defined perpendicular to a radial axis.

4. The container of claim 1, further comprising:

a first plateau extending from the neck between the first and second inclined ramp surfaces, the first plateau extending along the outer perimeter of the neck an angular distance between about twenty degrees and about forty-five degrees.

5. The container of claim 1, further comprising:

the container thread including a first full thread profile defined at a first full thread angular location positioned on the container thread, wherein a thread reference axis extends diametrically through the first full thread angular location, wherein the first ramp is angularly offset at a first ramp offset angle relative to the thread reference axis, and wherein the first ramp offset angle is between about ten degrees and about thirty degrees.

6. A container system for storing material, the container system comprising:

a closure having a cap and a tamper-evident ring frangibly attached to the cap, the tamper-evident ring including at least one ring tooth protruding radially inward;

a container body having a neck defining an opening in the container, the neck including a container thread; and a first ramp protruding from the neck below the container thread, the first ramp including first and second inclined ramp surfaces, the first inclined ramp surface oriented at a first ramp angle relative to a first local reference axis, the second inclined surface oriented at a second ramp angle relative to the first local reference axis, wherein the first and second ramp angles are each between about five degrees and about forty-five degrees, and wherein the first local reference axis is defined perpendicular to a radial axis.

7. The container system of claim 6, wherein the ramp includes a ramp height H extending above the neck surface, wherein H is between about 0.5 and about 3.0 millimeters.

8. The container system of claim 6, further comprising:

a second ramp protruding from the neck below the container thread, the second ramp including a third inclined ramp surface oriented at a third inclined ramp angle relative to a second local reference axis and a fourth inclined ramp surface oriented at a fourth inclined ramp angle relative to the second local reference axis, wherein the second ramp is located at an angular position on the neck diametrically opposite the first ramp.

9. A container for use with a closure having a tamper-evident ring frangibly attached to the closure, the container comprising:

a container body including a neck, the neck including a substantially cylindrical neck surface;

a container thread extending from a neck surface for engaging the closure;

an annular rim extending from the neck surface below the container thread for engaging the tamper-evident ring; and a closure-retaining structure extending from the neck surface below the container thread, the closure-retaining structure including a first inclined ramp surface oriented at a first inclined ramp angle and a second inclined ramp surface oriented at a second inclined ramp angle, wherein the first and second inclined ramp angles are each between about five degrees and about forty-five degrees relative to a first local reference axis, wherein the first local reference axis is defined substantially perpendicular to a radial axis.

10. The container of claim 9, wherein the first closure-retaining structure further comprises a first plateau protruding from the neck surface between the first and second inclined ramp surfaces, the first plateau extending along an outer perimeter of the container neck a first angular distance between about twenty degrees and about fifty degrees.

11. The container of claim 9, further comprising:

a second closure-retaining structure extending from the neck surface diametrically opposite the first closure-retaining structure, the second closure-retaining structure including a third inclined surface oriented at a third inclined ramp angle and a fourth inclined surface oriented at a fourth inclined ramp angle, wherein the third and fourth inclined ramp angles are between about five and about forty-five degrees relative to a second local reference axis, and wherein the second closure-retaining structure further comprises a second plateau extending from the neck surface between the third and fourth inclined ramp surfaces, the second plateau extending along the outer perimeter of the container neck an angular distance between about twenty and about fifty degrees.

12. The container of claim 11, further comprising:

a third closure-retaining structure extending from the neck surface, the third closure-retaining structure including a fifth inclined ramp surface oriented at a fifth inclined ramp angle and a sixth inclined ramp surface oriented at a sixth inclined ramp angle, wherein the third-closure-retaining structure is angularly offset from the first closure-retaining structure by a first offset angle between about seventy degrees and about eighty degrees; and a fourth closure-retaining structure extending from the neck surface, the fourth closure-retaining structure including a seventh inclined ramp surface oriented at a seventh inclined ramp angle and an eighth inclined ramp surface oriented at an eighth inclined ramp angle, wherein the seventh and eight inclined ramp angles are each between about five and about forty-five degrees, and wherein the fourth closure-retaining structure is angularly offset from the second closure-retaining structure by a second offset angle between about seventy and about eighty degrees.

13. A container system for storing material, comprising:

a container having a neck, the neck including a container thread;

an annular rim protruding from the neck below the container thread;

a composite closure disposed on the container, the composite closure comprising an annular closure band and a closure disk, the closure disk having an annular outer rim, the annular outer rim having a lower disk edge;

a tamper-evident ring frangibly attached to the composite closure by a plurality of frangible bridges, each frangible bridge having a maximum bridge elongation defined as the maximum axial elongation the bridge can withstand before rupturing, the tamper-evident ring engages the annular rim protruding from the neck during closure removal; and a disk retainer bead protruding radially inward from the closure band, the disk retainer bead defining a maximum disk travel distance between the lower disk edge and the disk retainer bead when the closure is fully-seated on the container, wherein the maximum disk travel distance is greater than each maximum bridge elongation.

14. The container system of claim 13, wherein a ratio of maximum disk travel distance to maximum bridge elongation is greater than about 1.1.

15. The container system of claim 13, wherein the ratio of maximum disk travel distance to maximum bridge elongation is configured so that each of the plurality of frangible bridges ruptures before the disk retainer bead engages the lower disk edge during closure removal.

16. A method of sealing a container using a tamper-evident container system, the method comprising the steps of:

(a) providing a container having a neck with an annular rim protruding from the container neck, wherein the annular rim engages a tamper-evident ring frangibly attached to a mating closure by a plurality of frangible bridges;

(b) attaching the mating closure to the neck so that the tamper-evident ring engages the annular rim, wherein the closure provides a releasable annular seal between the neck and the closure; and (c) removing the closure from the neck so that the tamper-evident ring is rotatable with the closure and each one of the plurality of frangible bridges is broken in tension before the annular seal is released, wherein the closure includes a closure disk encircled by a closure band;

the closure band further comprises a disk retainer bead protruding radially inward from the closure band and engaging the closure disk;

the closure disk further comprises a lower disk edge operative to engage the disk retainer bead during closure removal; and each one of the plurality of frangible bridges is broken before the lower disk edge engages the disk retainer bead.

* * * * *